US005711265A

United States Patent [19]

Duve

[11] Patent Number: 5,711,265

[45] Date of Patent: Jan. 27, 1998

[54] ROTARY VALVE DRIVE MECHANISM

[76] Inventor: Donald A. Duve, 835 Donna Ave., Aurora, Ill. 60505

[21] Appl. No.: 684,998

[22] Filed: Jul. 22, 1996

[51] Int. Cl.[6] ..... F01L 7/10

[52] U.S. Cl. ..... 123/190.2; 123/81 B; 123/190.1

[58] Field of Search ..... 123/81 R, 81 B, 123/59.1, 190.1, 190.4, 190.8, 190.2

[56] References Cited

U.S. PATENT DOCUMENTS

| | | | |
|---|---|---|---|
| 667,590 | 2/1901 | Simpson | 123/81 R |
| 1,215,993 | 2/1917 | Rimbach | 123/81 B |
| 1,732,911 | 10/1929 | Ragan | 123/81 B |
| 1,775,581 | 9/1930 | Baer . | |
| 1,830,796 | 11/1931 | Jones | 123/81 B |
| 3,945,364 | 3/1976 | Cook . | |
| 4,010,727 | 3/1977 | Cross . | |
| 4,116,189 | 9/1978 | Asaga . | |
| 4,119,077 | 10/1978 | Vallejos | 123/81 B |
| 4,198,946 | 4/1980 | Rassey . | |
| 4,455,976 | 6/1984 | McCandless | 123/81 R |
| 4,944,261 | 7/1990 | Coates . | |
| 4,953,527 | 9/1990 | Coates . | |
| 4,969,918 | 11/1990 | Taniguchi | 123/81 B |
| 4,976,227 | 12/1990 | Draper | 123/190.1 |
| 4,976,232 | 12/1990 | Coates . | |
| 4,989,553 | 2/1991 | Coates . | |
| 4,989,576 | 2/1991 | Coates . | |
| 5,109,814 | 5/1992 | Coates . | |
| 5,205,251 | 4/1993 | Conklin | 123/190.1 |

FOREIGN PATENT DOCUMENTS

| | | | |
|---|---|---|---|
| 513322 | 11/1930 | Germany | 123/81 R |

OTHER PUBLICATIONS

Coates Engines Machine Design: Rotary Valve Speeds Closer to Reality, Jul. 23, 1992, pp. 34–35.

*Primary Examiner*—Erick R. Solis
*Attorney, Agent, or Firm*—Patnaude Videbeck & Marsh

[57] ABSTRACT

An improved drive mechanism for rotary valves of the type used in internal combustion engines indexes the valves in selected attitudes of rotation to align the valve passage with an inlet or exhaust port and hold the valve in alignment for a selectable duration of crankshaft rotation. In like fashion, the valves are also indexed to close off an inlet or exhaust port for a selected duration of crankshaft rotation. Flow into and out of an engine cylinder is improved because each valve is held for a longer period of time in a full open position. while compression and power strokes are made more efficient by the gas seal maintained while the valves are positioned to close off the intake and exhaust ports.

18 Claims, 9 Drawing Sheets

ROTARY VALVE DRIVE MECHANISM

FIELD OF THE INVENTION

This invention relates generally to rotary valve mechanisms for internal combustion engines and, in particular, to an improved drive mechanism for rotary valves.

BACKGROUND OF THE INVENTION

Internal combustion engines use an arrangement of intake valves to deliver fuel-and-air mixtures to each engine cylinder and exhaust valves to direct the by-products of engine combustion to an exhaust manifold. Most engines use "push" or "popper" valve systems in which spring-biased valves are pushed by shaft-mounted cams to open and close in a carefully timed sequence. Poppet valves operate in reciprocating fashion between open and closed positions. When closed, the valve must fit closely to a valve seat formed in the cylinder head, held in position by a valve spring. To open, the valve stem is pushed by the camshaft away from the valve seat and into the cylinder, compressing the spring, which then pushes the valve back to the closed position as the camshaft continues its rotation.

A series of patents issued to George J. Coates discloses the operation of rotary-type valves and the differences between such valves and poppet-type valves. As Coates points out, poppet valve systems require assembly and maintenance of a large number of mechanical parts such as springs, guides, cotter pins, cams, push rods and rocker arms, and demonstrate a tendency to float or bounce at high engine revolutions, sometimes causing the valve to come into contact with the piston, problems that can be avoided through use of a rotary valve system.

U.S. Pat. No. 4,953,527 (Coates) teaches and describes a spherical rotary valve assembly for an internal combustion engine with intake rotary valves having donut-shaped cavities communicating with a passageway for conducting fuel-air mixtures and an aperture formed through the valve communicating with the cavity and alignable with an intake port on an engine cylinder, and exhaust rotary valves, each having a peripherally-positioned aperture communicating with a laterally-positioned aperture to form a path for exhaust gases from an engine cylinder when the aperture registers with an exhaust port on the cylinder.

U.S. Pat. No. 4,944,261 (Coates) teaches and describes a spherical rotary valve assembly for an internal combustion engine in which each rotary valve has two passageways and rotates at one-fourth the speed of the crankshaft and which has a drip-type lubrication system for the valves.

U.S. Pat. No. 4,976,232 (Coates) teaches and describes a valve seat for rotary engine valves which fits around and coaxial with a round inlet or exhaust port and which forms a seal preventing leakage of gases as the valve rotates.

U.S. Pat. No. 4,985,576 (Coates) teaches and describes a cylinder head attachable to a conventional internal combustion engine. The cylinder head is fitted with disk-shaped rotary valves into which circumferential grooves are milled. The valves rotate in valve cavities in the cylinder head with each groove being rotated into position to form a flow path between an existing inlet or exhaust port in the cylinder and the corresponding intake or exhaust manifold.

U.S. Pat. No. 4,989,558 (Coates) teaches and describes variations of the spherical rotary valve assembly for an internal combustion engine of the '527 Coates patent.

U.S. Pat. No. 5,109,814 (Coates) teaches and describes a spherical rotary valve having peripherally-formed openings shaped to allow quicker opening and closing of the intake and exhaust ports of an engine cylinder.

The Coates engine and valve train is also described in the brochure entitled "Coates Engines at the Forefront of Technology", printed by Coates Enterprises, Ltd. of Wall Township, New Jersey, in the June, 1991 issue of "Pennsylvania Automotive" magazine at page 10, in the September, 1991 issue of "Truckin'" magazine (volume 17, No. 9) at page 26 and in the Jul. 23, 1992 issue of "Machine Design" magazine at page 34.

U.S. Pat. No. 1,775,581 (Baer) teaches and describes a rotary valve and seal arrangement for internal combustion engines.

U.S. Pat. No. 4,010,727 (Cross, et al.) teaches and describes an internal combustion engine having rotary valves with a lubrication system adapted to provide lubricant to the valve while removing any excess lubricant prior to the valve opening.

U.S. Pat. No. 3,945,364 (Cook) teaches and describes a rotary valve for an internal combustion engine which is arranged to act as both an intake and exhaust valve.

U.S. Pat. No. 4,116, 189 (Asaga) teaches and describes an internal combustion engine with rotary valves that include a "bomb" valve to trap unburned exhaust products and recirculate them into the cylinder during the next intake and ignition cycle.

U.S. Pat. No. 4,198,946 (Rassey) teaches and describes a rotary valve construction for an internal combustion engine having coolant passages formed to allow engine coolant to cool the valves and which also drives the valve shafts via a direct connection to the crankshaft rather than using a timing belt or chain.

The references discussed above are concerned with the advantages rotary valves demonstrate over poppet valves and address some of the problems inherent in rotary valve systems, such as sealing around the cylinder ports, lubrication and the like. None of the foregoing references teach or suggest the use of a valve drive arrangement that provides intermittent movement of the intake and exhaust valves into and out of alignment with the intake and exhaust ports of an engine cylinder. Intermittent motion devices are well-known, with perhaps one of the most familiar being the motion picture projector, where individual frames of film are briefly aligned with a lamp-and-shutter mechanism and then advanced so that the next frame moves into brief, intermittent alignment. When a rotary valve is "held" in register or alignment with a corresponding engine cylinder port a larger volume is available per unit time for the intake of fresh fuel and air or the exhausting of combustion byproducts. This allows the engine to "breathe" more easily and operate more efficiently.

BRIEF DESCRIPTION OF THE DRAWINGS

These and further objects of the present invention may be understood by viewing the accompanying drawings, in which.

DETAILED DESCRIPTION OF THE DRAWINGS

Depicted schematically throughout are common components representative of known internal combustion engines such as a crank shaft, a piston rod rotatably attached at one end to the crank shaft, a piston attached to another end of the piston rod, a cylinder within which the piston moves in a reciprocal, up-and-down motion, an intake port through which a fuel-air mixture is drawn into the cylinder, an exhaust port through which exhaust gases and other byproducts of combustion are expelled from the cylinder, a rotary intake valve which selectively blocks and unblocks the intake port, a rotary exhaust valve which selectively blocks and unblocks the exhaust port and a timing gear system to control the position of the intake and exhaust valves throughout the engine cycle. Omitted from the schematic drawings depicting the invention are other common internal combustion engine parts such as spark plugs, piston rings, oil and other seals, engine block, exhaust and intake manifolds and the like. Throughout the description of a preferred embodiment of the present invention, it is assumed that the common engine components omitted perform the usual functions such components perform in known internal combustion engines, and that the engine is one of the type where the piston is moved within the cylinder through four distinct stroke segments: (1) intake, where the piston moves downward to draw a fuel-air mixture into the cylinder; (2) compression, where the piston moves upward to compress the fuel-air mixture in the direction of the spark plug; (3) ignition/power, where the spark plug ignites the compressed fuel-air mixture to force the piston downward; and (4) exhaust, where the piston moves upward to force the byproducts of combustion out of the cylinder, readying it for another cycle to begin. While the following descriptions are drawn to use of the invention in a single cylinder, it should be readily appreciated that the invention can also be used in multi-cylinder configurations.

Figure 1:
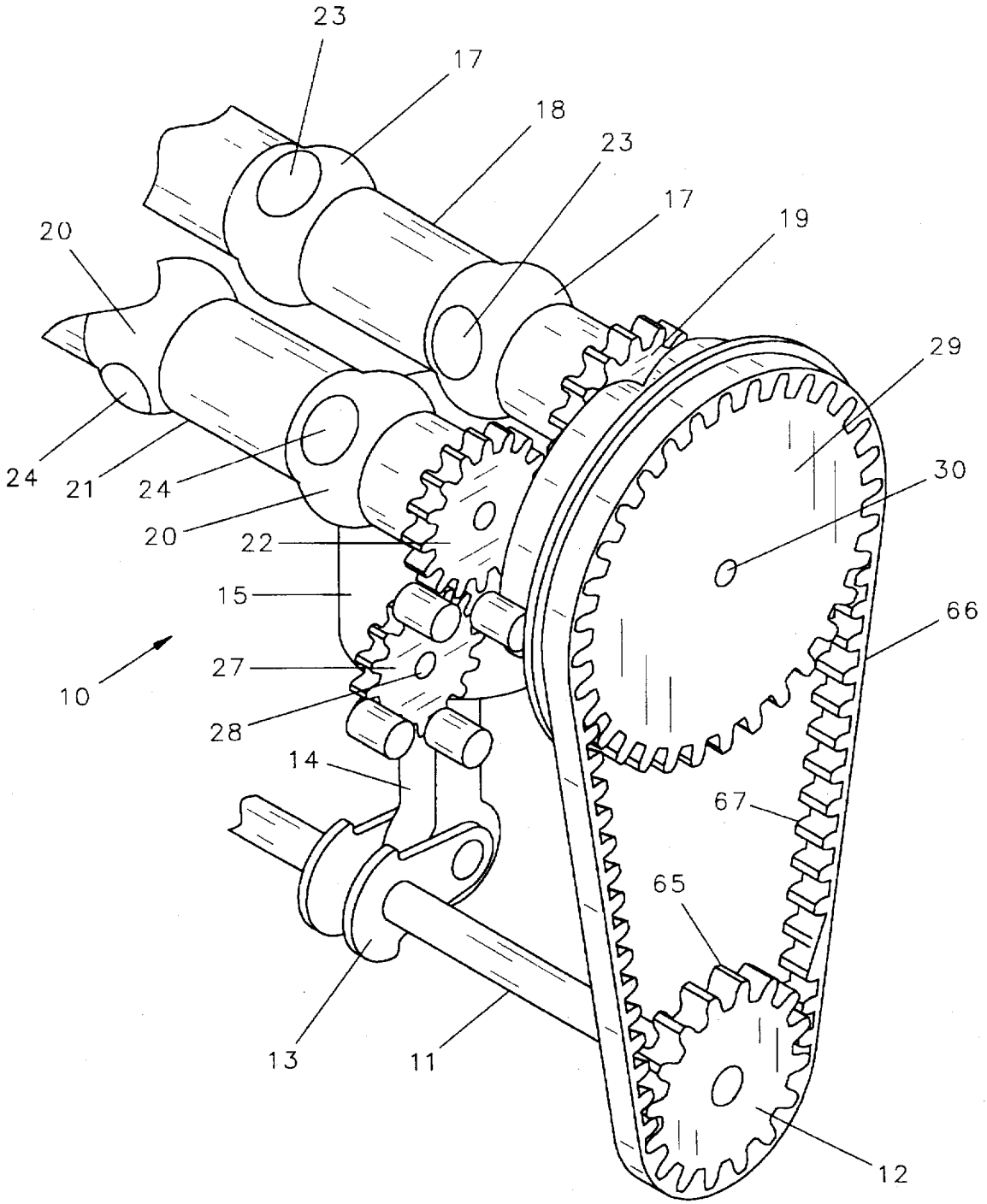
FIG. 1 is a partial frontal perspective view of a rotary valve drive mechanism assembled in accordance with a preferred embodiment of the present invention.

Referring now to FIG. 1, the numeral 10 indicates generally a drive mechanism for rotary valves used in internal combustion engines of the type described above. For purposes of clarity and simplicity, FIG. 1 and the remaining figures are drawn to a representative arrangement of the elements of the present invention in a single engine cylinder.

Figure 2:
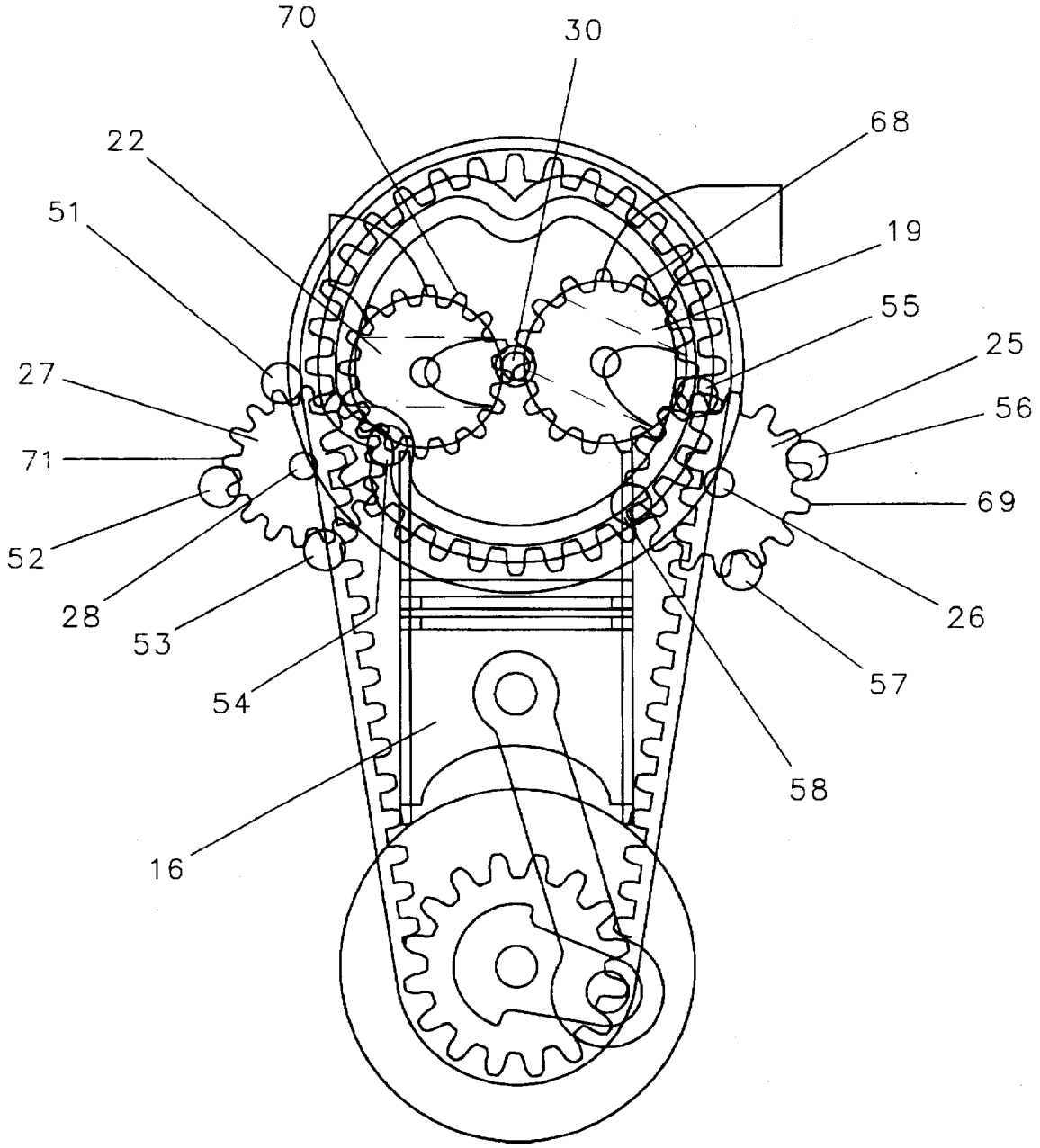
FIG. 2 is a front schematic view of the embodiment of FIG. 1 showing the cam followers and cam track.
Figure 3:
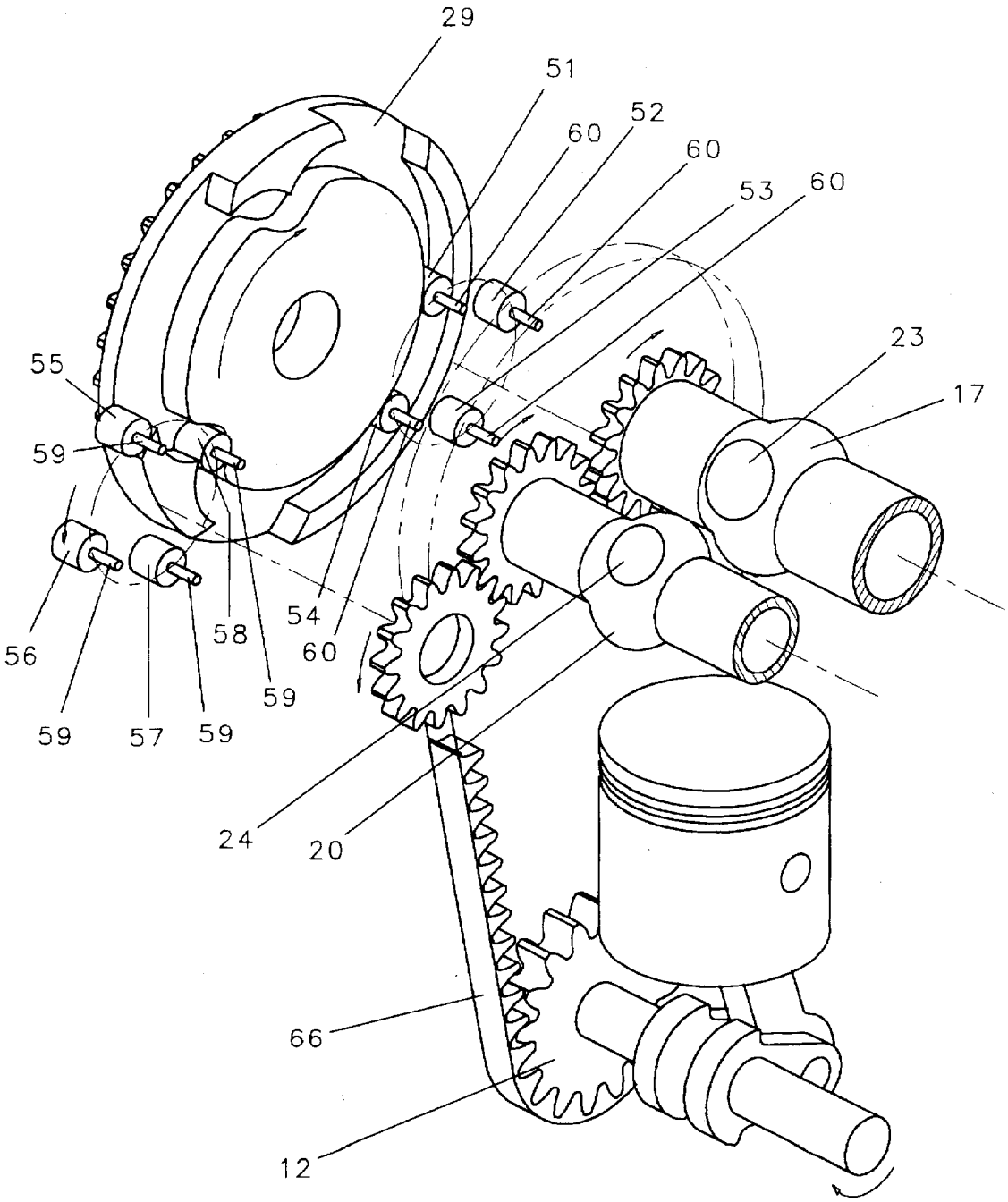
FIG. 3 is an exploded schematic view showing the spatial relationship between the valve drive mechanism, valve and piston.

As seen in FIGS. 1, 2 and 3, common internal combustion engine components are depicted, namely, a crank shaft 11, a drive gear 12, a crank arm 13, a piston rod 14, a piston 15 and a cylinder 16. As seen in FIG. 1, a series of rotary intake valves 17 are mounted to an intake valve shaft 18 at one end of which an intake valve drive gear 19 is mounted. In like fashion, a series of rotary exhaust valves 20 are mounted to an exhaust valve shaft 21 at one end of which an exhaust valve drive gear 22 is mounted. Drive gears 20 and 22 are advanced to move rotary valves 17 and 20 in an intermittent rotary motion in a manner to be described.

As seen in FIGS. 1 and 3, each intake valve 17 has an intake valve passage 23 formed therethrough, while each exhaust valve 20 has a correspondingly positioned exhaust valve passage 24 formed therethrough as well. Passage 23, when aligned with a cylinder intake port and an intake manifold defines an entry path for the engine's fuel-air mixture, while passage 24, aligned with a cylinder exhaust port and an exhaust manifold defines an exhaust path for the engine's combustion byproducts.

As will be explained more fully, it is a feature of the present invention that each port-valve-manifold alignment is "held" as each valve is intermittently moved into and out of registration with a corresponding port and manifold, maximizing the cross-sectional area available for fluid flow. With respect to the intake valve, this creates a more efficient flame front during combustion. It is also a feature of the present invention that each valve is also "held" in a position that blocks the port, maximizing the sealing effect of the valve during the compression and power portions of the stroke. This holding action makes it possible to use valve passages that are smaller in diameter than those of poppet valves sized to work with the same engine configurations. Smaller valve passages require smaller rotary valves and the smaller mass of the smaller valves results in lower total forces and stresses on the rotary valve mechanism during engine operation. Smaller valve passages may also result in increased gas velocities through the passages which may aid in packing the engine cylinder with fuel and improve fuel-air mixing.

As best seen in FIGS. 1 and 2, intake valve drive gear 19 and exhaust valve drive gear 22 are mounted proximate one another at the ends, respectively, of intake valve shaft 18 and exhaust valve shaft 21. Drive gear 19 interengages an intake cam indexer 25 which, in turn, is rotatably affixed to a cam gear mounting pin 26 such that rotation of cam indexer 25 produces a corresponding rotation of drive gear 19 and, thereby, intake valve shaft 18. In like fashion, exhaust drive gear 22 interengages an exhaust cam indexer 27 which, in turn, is rotatably affixed to a cam gear mounting pin 28 such that rotation of cam indexer 27 produces a corresponding rotation of drive gear 22 and, thereby, exhaust valve shaft 21.

Although not herein specifically shown, components such as shafts 18 and 21, and pins 26 and 28 are attached to and supported by the engine with which such components are used. For example, pins 26 and 28 can be mounted within a specially-designed housing or to a suitably stable and sturdy engine component not herein specifically shown, such as a bracket or plate affixed to the engine. Shafts 18 and 21 are rotatably mounted to and supported by appropriate support bearings and valve seats to allow the shafts to rotate smoothly and easily to drive valves 17 and 20 in a mechanically efficient and reliable manner.

Figure 4:
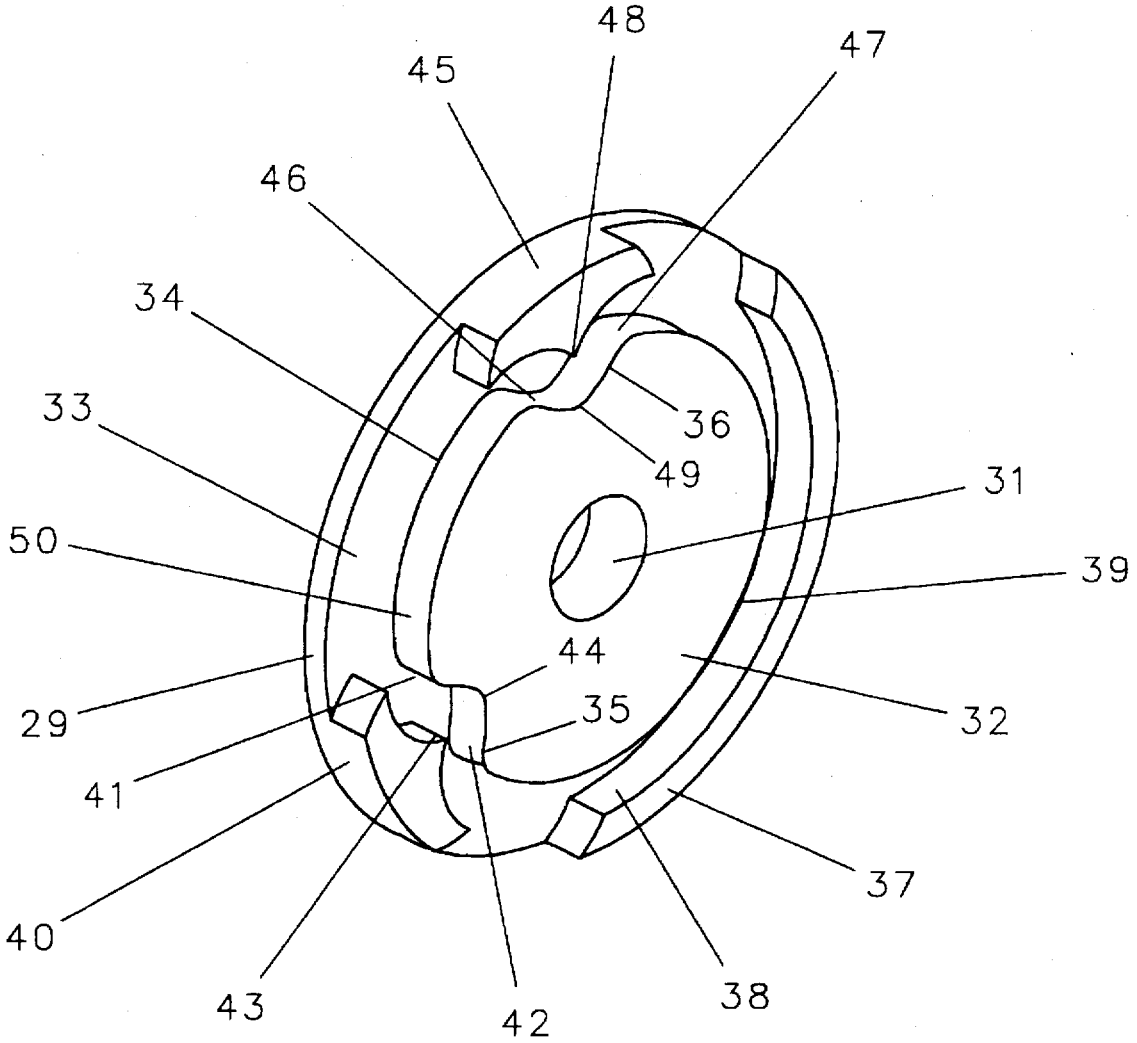
FIG. 4 is a perspective view of the cam gear showing the cam track segments.

It is a feature of the invention that rotation of crankshaft 11 causes shafts 18 and 21 to rotate with an intermittent motion which successively moves valve passages 23 and 24 into and out of register with intake and exhaust ports of cylinder 16. Referring to FIGS. 3 and 4, a cam driver 29 is shown as a preferred method of controlling the movement of cam indexers 25 and 27. Cam driver 29 is driven via a timing belt 66 by gear 12, with gear 29 making a 180° rotation for every 360° of gear 12.

As seen in FIG. 4, cam driver 29 is circular in shape and is rotatably supported by cam driver shaft 30 through central aperture 31. As seen in FIG. 4, raised backing plate 32 on a rear face 33 of cam driver 29 defines a generally circular and continuous land 34 having first and second indentations 35 and 36 formed therein. Indentation 35 has a first indentation wall 41 and a second indentation wall 42 which curve toward each other and meet at "valley" 44. In like fashion, indentation 36 has a first indentation wall 46 and a second indentation wall 47 which curve toward each other and meet at "valley" 49.

A series of guides are formed integrally with cam driver 29 about portions of the outer periphery of and extending above rear face 33. First guide 37 is formed as a generally circular segment having an inner guide wall 38 parallel to and spaced apart from that segment 39 of land 34 which itself is formed as a segment of a circle and which, as shown in FIG. 4, extends in a counterclockwise direction between indentations 35 and 36. Second guide 40 is formed opposite and spaced apart from indentation 35 and has a pair of inner guide walls formed opposite and parallel to indentation walls 41 and 42 as arcuate segments intersecting at a cusp 43 which is positioned directly opposite valley 44 of indentation 35. In like fashion, third guide 45 is formed opposite indentation 36 and has inner guide walls opposite and parallel to indentation walls 46 and 47 formed as intersecting arcuate segments intersecting at a cusp 48 opposite valley 49 of indentation 36. Completing land 34 is land segment 50 which is formed as a segment of a circle and as shown in FIG. 4, extends in a counterclockwise direction from guide 40 to guide 45.

Land 34 thus comprises a continuous cam track surface consisting of semi-circular segment 39, walls 41, 42 and valley 44 of indentation 35, semi-circular segment 50 and walls 46, 47 and valley 49 of indentation 36. Guides 37, 40 and 45 respectively are generally parallel to those segments of land 34 directly opposite them and are spaced apart from land 34 a distance sufficient to accommodate a series of cam followers as described next.

FIGS. 1, 2 and 3 show in detail the construction of intake cam indexer 25 and exhaust cam indexer 27. As seen in FIG. 2, exhaust cam indexer 27 has four cam followers 51, 52, 53, and 54, and FIG. 2 shows cam followers 55, 56, 57 and 58 mounted to intake cam indexer 25. As seen in FIG. 3, cam followers 55, 56, 57 and 58 are rotatably mounted to and spaced equally about the periphery of gear 25 on shafts 59, while cam followers 51, 52, 53 and 54 are mounted to and spaced about gear 27 in similar fashion on shafts 60. Preferably, four such cam followers are mounted to each such gear in a regular and equidistantly-spaced array, that is, with all four cam followers spaced at 90° intervals and at equal radii from the center of the indexer.

Cam followers of the type discussed herein are commercially available from Torrington Bearing Company, Torrington, Conn. and are identified as Model CRS-8.

As seen in FIG. 1, cam driver 29 has gear teeth 64 formed about its periphery, while drive gear 12 has gear teeth 65 formed about its periphery. The timing belt or chain 66 has teeth or cogs 67 formed thereon sized and shaped to interengage teeth 64 and 65 whereby as drive gear 12 rotates in response to the rotation of crankshaft 11, timing gear 29 is also rotated.

FIG. 2 illustrates the interengagement of gear teeth 68 formed peripherally about intake valve drive gear 19 with gear teeth 69 formed peripherally about intake cam indexer 25. In like fashion, gear teeth 70 formed peripherally about exhaust valve drive gear 22 interengage gear teeth 71 formed peripherally about exhaust cam indexer 27. Thus, as gears 25 and 27 are driven, gears 19 and 22 are rotated, controlling the positions of valves 17 and 20, respectively.

In accordance with the following description of a preferred embodiment of the present invention, FIGS. 6 through 9 show cam indexers 25 and 27 positioned such that intake cam followers 55–58 and exhaust cam followers 51–54 follow land 34 to transmit an intermittent rotational motion to gears 25 and 27 and, thereby, via gears 19 and 22 to shafts 18 and 21.

Figure 6:
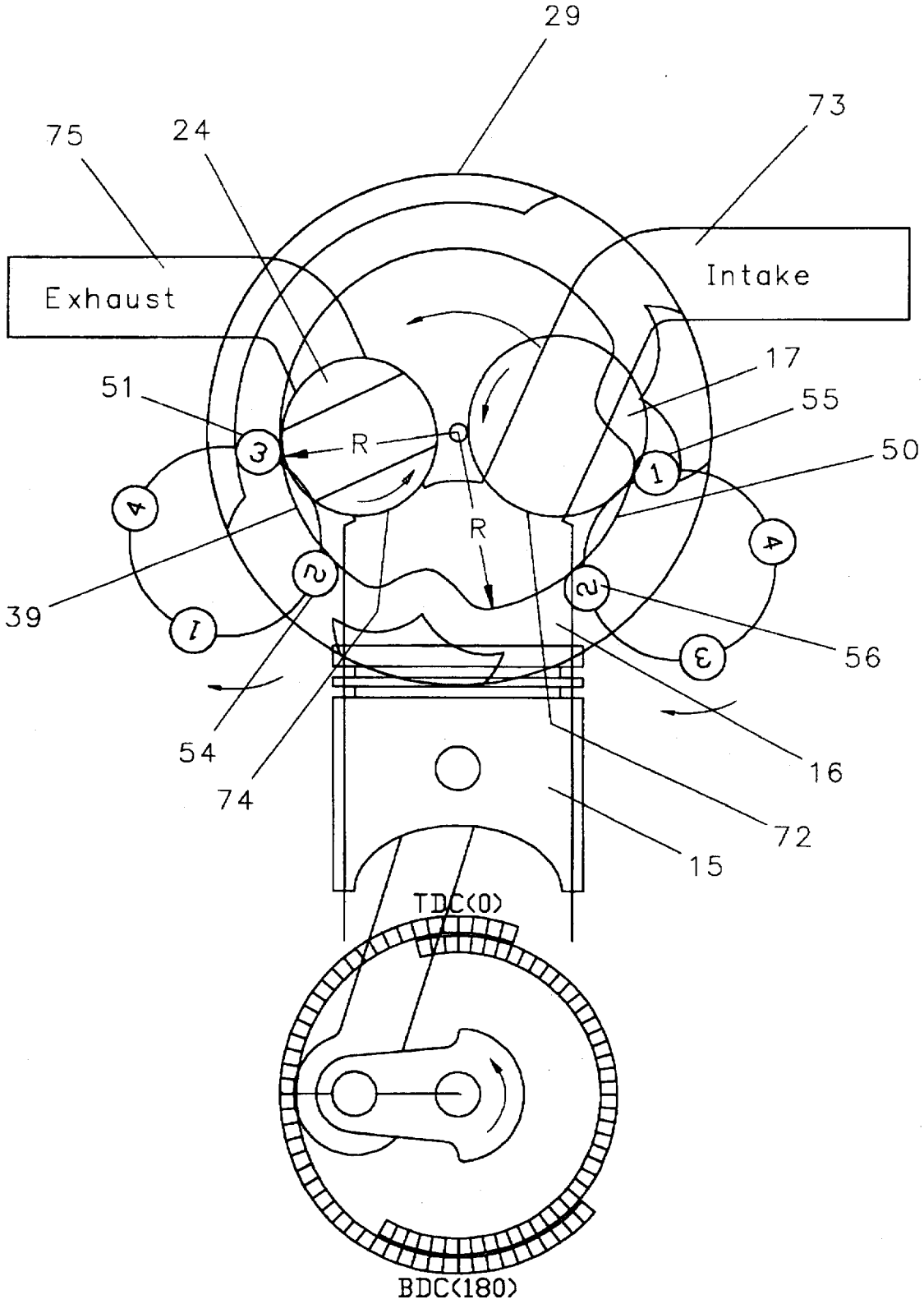
FIG. 6 is a front schematic view showing the relative positioning of the piston, cam followers and valves during the intake stroke.

FIG. 6 shows schematically the intake cycle of an internal combustion engine embodying the present invention. At this point in the cycle, intake valve 17 is turned to align or register valve passage 23 with an engine intake port 72 and an intake manifold 73. At this same time, exhaust valve 20 is turned to bring exhaust valve passage 24 out of register with an exhaust port 74 and an exhaust manifold 75, thereby closing off port 74. Piston 15 is moving downward, drawing a fuel-air mixture from intake manifold 73 through valve passage 23 and intake port 72 into cylinder 16.

Cam driver 29 is being rotated in a counterclockwise direction and, at this point in the engine cycle, intake cam followers 55 and 56 are contacted by and are moving along segment 50, while exhaust cam followers 51 and 54 are contacted by and are moving along segment 39. As seen in FIG. 6, segments 39 and 50 are of constant radius R as measured from cam driver shaft 30. So long as cam followers 51, 54, 55 and 56 are moving along a constant radius, gears 27 and 25 are not rotating and are not driving gears 22 and 19. As a result, valve shafts 21 and 18 are not turning, meaning that valves 20 and 17 remain stationary. In FIG. 6, this means that intake valve 17 is in full register with intake port 72 and intake manifold 73, while exhaust valve 20 fully closes off exhaust port 74 from exhaust manifold 75.

Figure 7:
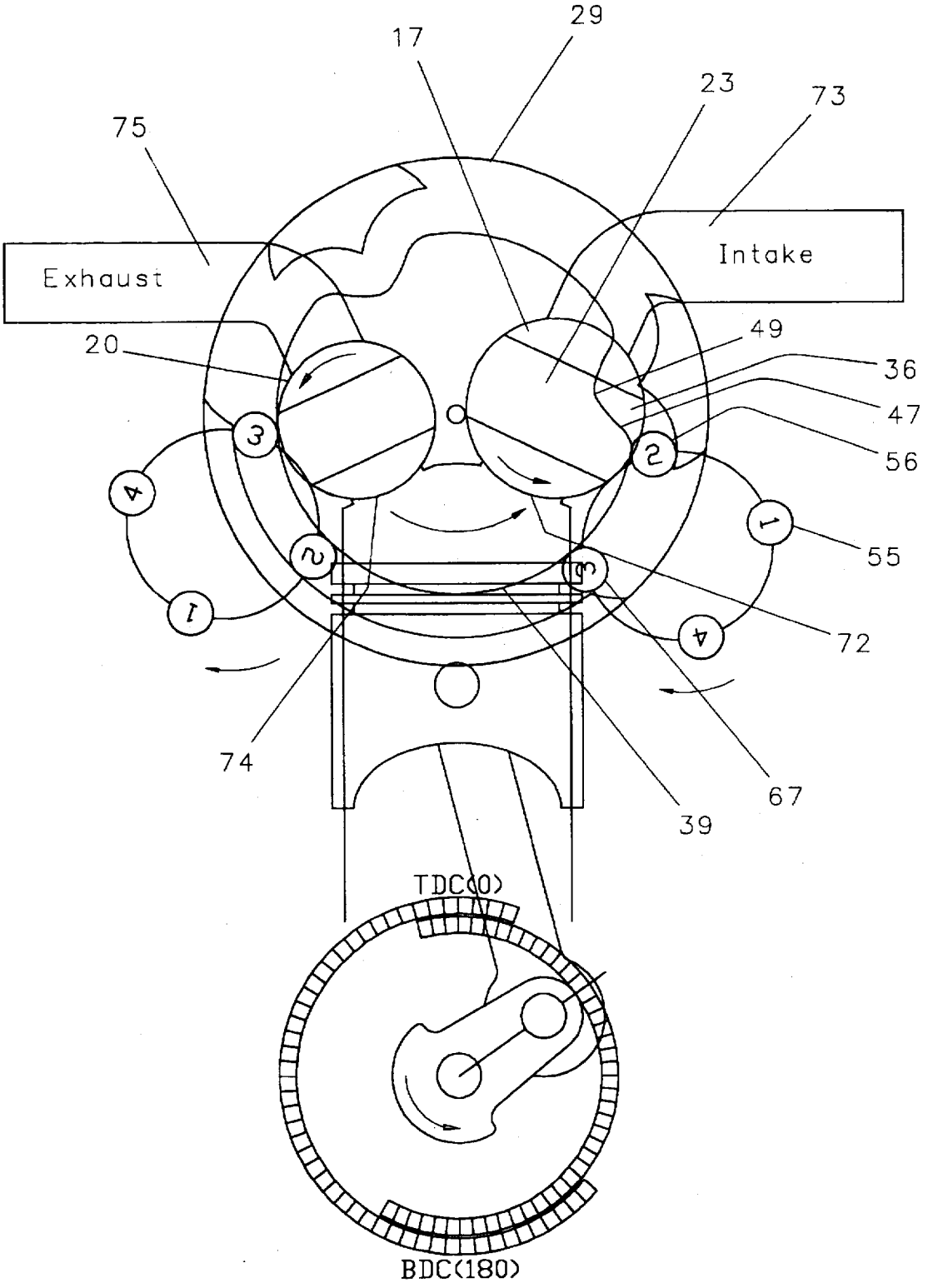
FIG. 7 is a front schematic view showing the relative positioning of the piston, cam followers and valves during the compression stroke.

As seen in FIGS. 4 and 7, as cam driver 29 continues to rotate in a counterclockwise direction, guide 45 and indentation 35 reach, contact and pass cam followers 56 and 55. As cam follower 56 reaches indentation 36, it is "rolled" toward valley 49 along a path which measures less than distance R, thereby rotating gear 25 about mounting pin 26 and allowing guide 45 to pass between cam followers 56 and 57 during rotation. Cam follower 56 is next directed along indentation wall 47 until guide 45 passes gear 25, bringing cam follower 57 into contact with segment 39, the position shown in FIG. 7. As a result of this rotation, gear 25 and, thereby, valve 17 have been rotated to bring intake valve 17 to a position where intake passage 23 is no longer in register with intake manifold 73, thereby sealing off intake port 72. Because cam followers 51 and 54 are still in contact with segment 39, exhaust valve 20 has not moved and is still blocking exhaust port 74. This is the compression portion of the engine cycle during which the fuel-air mixture is compressed by the upward movement of piston 15 in cylinder 16.

Figure 8:
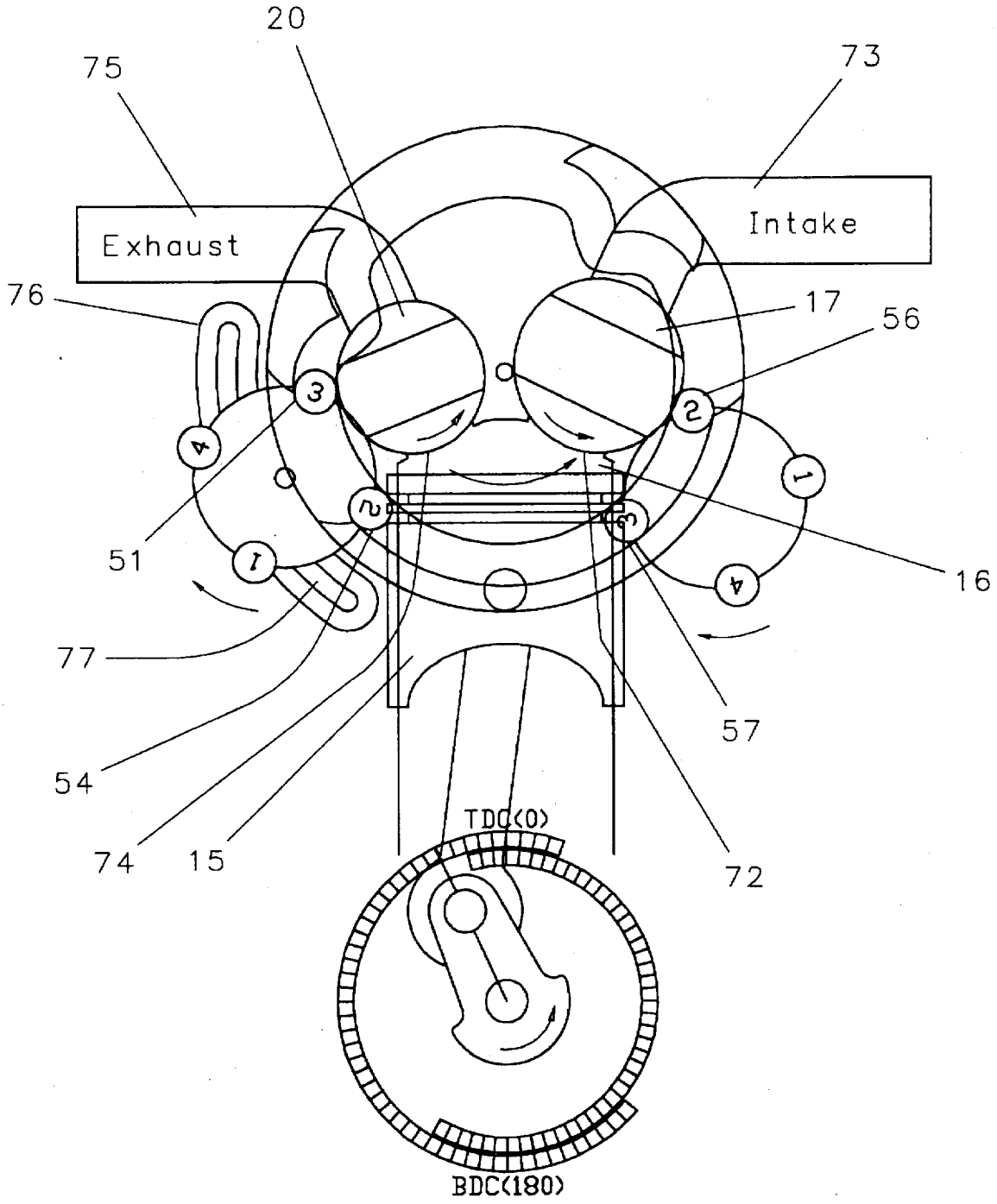
FIG. 8 is a front schematic view showing the relative positioning of the piston, cam followers and valves during the combustion or power stroke.

FIG. 8 illustrates the ignition/power part of the engine cycle in which both intake valve 17 and exhaust valve 20 are "closed", that is, oriented to block passage from, respectively, intake manifold 73 to intake port 72 and exhaust port 74 to exhaust manifold 75. During this part of the cycle, cam followers 51, 54, 56 and 57 contact and roll along constant-radius segment 39, rotating neither gear 25 nor gear 27.

Figure 9:
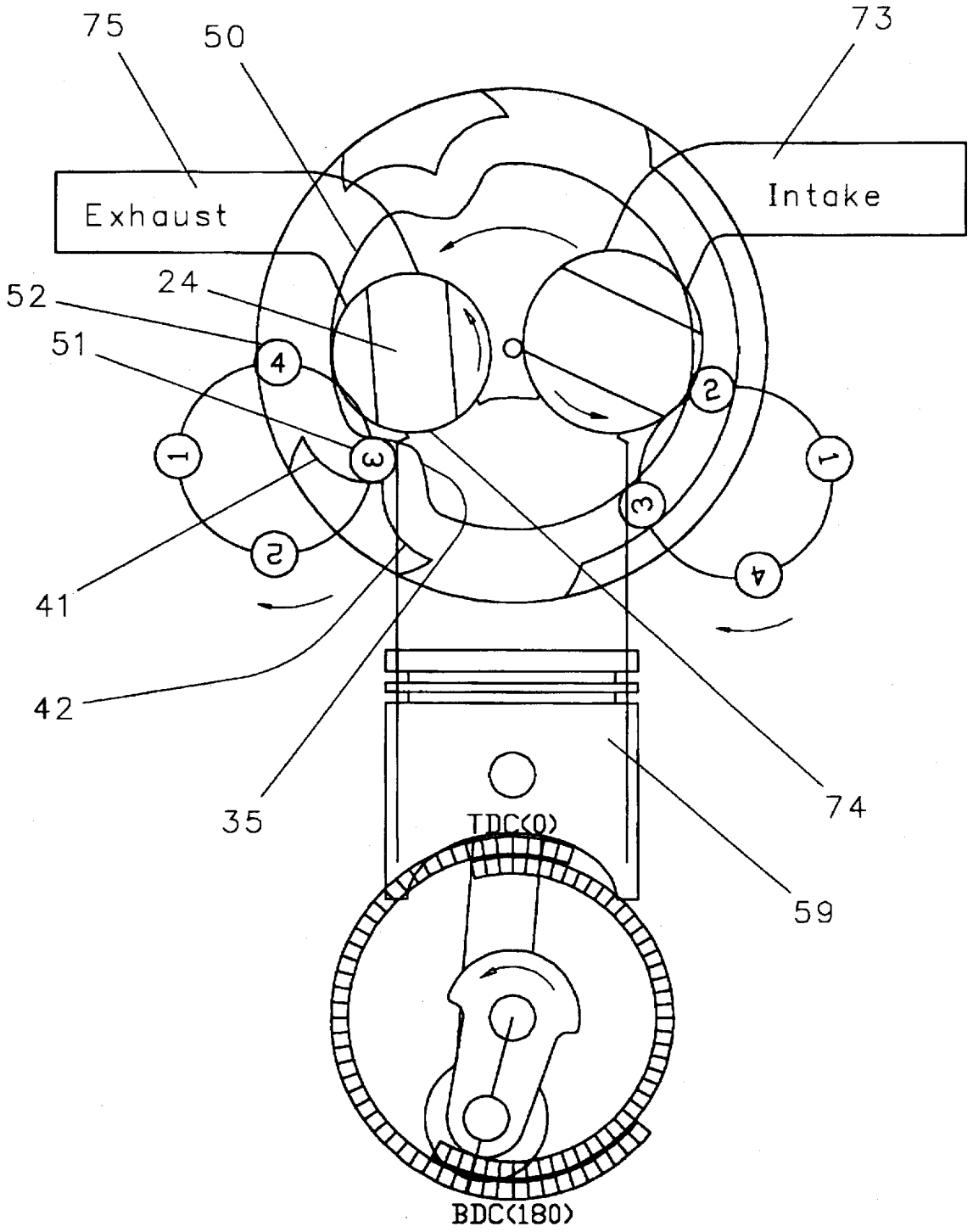
FIG. 9 is a front schematic view showing the relative positioning of the piston, cam followers and valves during the exhaust stroke.

In FIG. 9, the exhaust portion of the cycle is shown, where piston 15 moves upward to force the by-products of engine combustion out through exhaust port 74 and exhaust valve passage 24 to exhaust manifold 75. Exhaust valve 20 must then be moved to its "open" position, aligning valve passage 24 with exhaust port 74 and exhaust manifold 75: FIG. 9 shows how this has been accomplished. Continued counterclockwise rotation of cam driver 29 has moved cam follower 51 into contact with indentation 35 to rotate gear 27 and, thereby, exhaust valve 20. As seen in FIG. 9, cam follower 51 has moved along indentation wall 42 to a point just past valley 44 and is now in contact with indentation wall 41. In this attitude of rotation, exhaust valve 20 is partially open and, when cam follower 51 has moved past indentation wall 41 it will then contact constant-radius segment 50. By that time, valve 20 will be in its full open position and will remain so until continued rotation of gear 29 brings cam follower 51 into contact with indentation 36 to rotate gear 27 to close valve 20.

Figure 5:
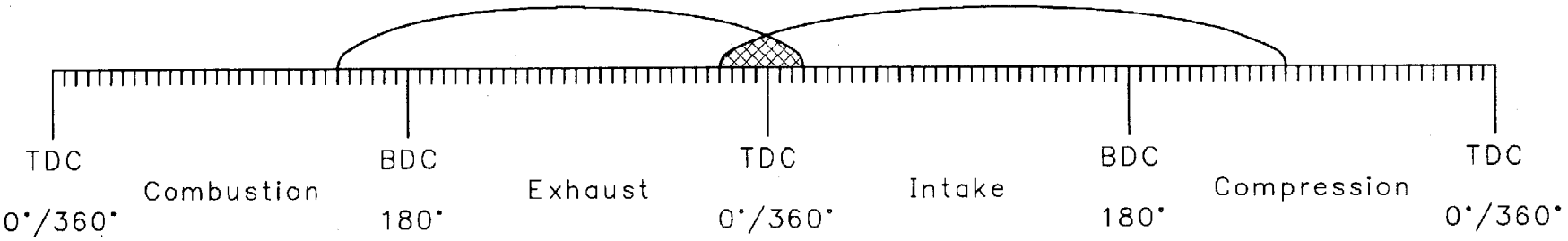
FIG. 5 is a chart illustrating the opening and closing of the intake and exhaust valves throughout an engine cycle.

FIG. 5 illustrates graphically the opening and closing of valves 17 and 20 throughout a typical engine cycle. As seen in FIGS. 6–9, the engine cycle is divided into 360° of rotation, with the designation TDC referring to that point at which piston 15 is at its highest, or "top dead center" position (corresponding to 0° rotation) and BDC, or "bottom dead center", where piston 15 is at its lowest position (corresponding to 180° rotation). Piston 15 thus moves up and down twice during a single full engine cycle. FIG. 5 illustrates that during a single engine cycle, exhaust valve 20 is open from about 36° before BDC to about 18° after TDC, for a cam duration of about 234° of crankshaft rotation. Similarly, intake valve 17 is open from about 24° before TDC to about 78° after BDC, for a cam duration of about 282° of crankshaft rotation. The height or amplitude of the exhaust/intake curves in FIG. 5 shows the degree to which each such valve is open during the cycle, and it can be seen that the valves remain in the full open position for about 80% of the time. It should be appreciated that keeping each valve in the full-open position does not require a cam rod to push and hold each valve against the compressive force of a valve spring and that the end portions of each valve curve represent the transition period where each valve is rotating from the full closed to the full open position and vice versa.

It is desirable for any valve operating system to be adjusted for optimum timing of the opening and closing of the valves. One method of adjusting the timing is to substitute a gear 29 having a different configuration of guides to affect the movement of gears 25 and 27. This is a choice that would typically be made when the engine is assembled, but one that would require disassembly when it was desired to change timing. Another method of adjusting the timing of the opening and closing of the intake and exhaust valves is to mount each cam indexer on an arcuate bracket 76 shown schematically in FIG. 8, having a centrally-positioned arcuate slot 77 paralleling the curvature of cam driver 29. As gear 27 is moved along slot 77, the position at which gear 27 contacts guides 40 and 45 changes, affecting the time at which exhaust valve 20 opens and closes with respect to intake valve 17. A similar bracket is preferably provided for intake valve 17. Timing of the opening and closing of the intake and exhaust valves with respect to one another can thus be adjusted over a finite range. As seen in FIG. 5, there are times where both valves are open simultaneously, and the valve adjustment mechanism described above allows one to fine-tune the engine's performance.

The cam track described hereinabove on cam 29 is configured to produce two changes of position of gears 25 and 27 per revolution, separated by two segments of time during which gears 25 and 27 remain stationary. It should be readily appreciated that other configurations may be adopted if necessary to effect fewer or more position changes per revolution and that these changes can be made by altering the configurations and sizes of the individual cam track elements, i.e., constant-radius portions 39 and 50 and indentations 35 and 36.

Use of specially configured cams 29 and the fact that the individual rotary valves remain in the full open position during an engine cycle makes possible the use of timing patterns not achievable with poppet valves.

Other variations in construction are also contemplated. For example, the foregoing preferred embodiment utilizes indexers 25 and 27 to turn gears 19 and 22, respectively. In an alternate configuration, it may be possible to mount indexers 25 and 27 directly to shafts 18 and 21.

While the foregoing has presented a preferred embodiment of the present invention, it is to be understood that the embodiment described is not intended and does not limit the scope of the invention. It is expected that others skilled in the art will develop variations which, while not specifically set forth herein, do not depart from and are within the spirit and scope of the invention as herein described and claimed.

What is claimed is:

1. In an internal combustion engine of the type having a crankshaft rotatable by the operation of said engine, at least one engine cylinder, said cylinder having at least one inlet or exhaust port, said engine further having at least one rotary engine valve mounted to a valve shaft and having a valve passage formed therethrough, said valve shaft being rotatable to bring said valve passage into and out of alignment with said port, the improvement comprising:

means for rotating said valve shaft, said rotation means including means to index said valve with said passage in a selected attitude of rotation with respect to said port, said indexing means including rotatable indexing gear means and cam driver means positioned in driving relation with said rotatable indexing gear means for interrupting the rotation of said valve in said selected attitude of rotation without interrupting the rotation of said crankshaft.

2. The apparatus as recited in claim 1 wherein said selected attitude of rotation is with said valve passage substantially aligned with said port.

3. The apparatus as recited in claim 1 wherein said selected attitude of rotation is with said valve passage sufficiently out of alignment with said port to substantially close off said port.

4. The apparatus as recited in claim 1 wherein said rotation means includes means for turning said rotation means responsive to the rotation of said crankshaft.

5. The apparatus as recited in claim 4 wherein said turning means includes a gear mounted to said crankshaft.

6. The apparatus as described in claim 1 wherein said indexing gear means includes an indexing gear and at least one cam follower thereon in driven relation with said cam driver means.

7. In an internal combustion engine of the type having a crankshaft rotatable by the operation of said engine, at least one engine cylinder, said cylinder having at least one inlet or exhaust port, said engine further having at least one rotary engine valve mounted to a valve shaft and having a valve passage formed therethrough, said valve shaft being rotatable to bring said valve passage into and out of alignment with said port, the improvement comprising:

means for rotating said valve shaft, said rotation means including means to index said valve with said passage in a selected attitude of rotation with respect to said port, said indexing means including a rotatable indexing gear means for interrupting the rotation of said valve in said selected attitude of rotation without interrupting the rotation of said crankshaft, said valve shaft rotating responsive to the rotation of said indexing gear;

said indexing gear having a plurality of cam followers rotatably mounted thereon;

a cam driver, said cam driver having a cam track formed thereon, said indexing gear and said cam driver arranged in fixed spatial relationship to bring said cam track into engagement with successive of said cam followers as said cam driver is rotated, said cam track having at least one semi-circular segment of fixed radius, said cam track having at least one segment indented to lead away from and return to said semi-circular segment;

means formed on said cam driver to guide successive of said cam followers to enter, follow and exit said indented segment, whereby said indexing gear is rotated from a first position to a second position as one said cam follower enters, follows and exits said indented segment, and remains in said second position until the next of said cam followers enter, follows and exits an indented segment.

8. The apparatus as recited in claim 7 wherein said cam track includes first and second semi-circular cam track segments and first and second of said indented segments.

9. The apparatus as recited in claim 8 wherein each said indented segment has one said guide means.

10. The apparatus as recited in claim 7 wherein each said semi-circular segment further includes a semicircular wall parallel to and spaced apart from said semi-circular segment by a distance sufficient to allow said cam followers to fit therebetween.

11. The apparatus as recited in claim 7 wherein each said guide means comprises a guide block having inner block surfaces parallel to and opposite said indentation, and spaced apart from said indentation by a distance sufficient to allow said cam followers to fit therebetween.

12. The apparatus as recited in claim 7 wherein each said indexing gear is rotated through an arc of about 90° each time one said cam follower enters, follows and exits one said indentation.

13. The apparatus as recited in claim 7 wherein each said indexing gear has four said cam followers mounted thereto in a regular and equidistantly spaced array.

14. The apparatus as recited in claim 13 wherein said indexing gear is circular.

15. In an internal combustion engine of the type having a crankshaft rotatable by the operation of said engine, at least one engine cylinder, said cylinder having at least one inlet or exhaust port, said engine further having at least one rotary engine valve mounted to a valve shaft and having a valve passage formed therethrough, said valve shaft being rotatable to bring said valve passage into and out of alignment with said port, the improvement comprising:

means for rotating said valve shaft, said rotation means including means to index said valve with said passage in a selected attitude of rotation with respect to said port, said indexing means including a rotatable indexing gear, said valve shaft rotating responsive to the rotation of said indexing gear;

said indexing gear having a plurality of cam followers rotatably mounted thereon;

a cam driver, said cam driver having a cam track formed thereon, said indexing gear and said cam driver arranged in fixed spatial relationship to bring said cam track into engagement with successive of said cam followers as said cam driver is rotated said cam track having at least one semi-circular segment of fixed radius, said cam track having at least one segment indented to lead away from and return to said semi-circular segment; and means formed on said cam driver to guide successive of said cam followers to enter, follow and exit said indented segment, whereby said indexing gear is rotated from a first position to a second position as one said cam follower enters, follows and exits said indented segment, and remains in said second position until the next of said cam followers enters, follows and exits said indented segment.

16. The apparatus as recited in claim 15 wherein said cam track has formed thereon, in sequence, a first, semi-circular segment, a first indented segment, a second semi-circular segment and a second indented segment, said first semi-circular segment being longer than said second semi-circular segment, each said indented segment having one said guide means comprises a guide block having inner block surfaces parallel to and opposite said indentation, and spaced apart from said indentation by a distance sufficient to allow said cam followers to fit therebetween, whereby each said indexing gear is rotated through an arc of about 90° each time one said cam follower enters, follows and exits one said indentation.

17. The apparatus as recited in claim 15 wherein said indexing means includes means to adjust the timing of said indexing with respect to the rotation of said crankshaft, said timing means including means to selectively reposition said indexing gear along an arc parallel to and spaced apart from said semi-circular segments.

18. In an internal combustion engine of the type having a crankshaft rotatable by the operation of said engine, at least one engine cylinder, said cylinder having at least one inlet port and at least one exhaust port, said engine further having one rotary intake valve associated with each such intake port and mounted to an intake valve shaft and one rotary exhaust valve associated with each such exhaust port and mounted to an exhaust valve shaft, each said rotary intake and exhaust valve having an intake passage formed therethrough, each said valve shaft being rotatable to bring said intake valve passages into and out of alignment with said intake ports and to bring said exhaust valve passages into and out of alignment with said exhaust ports, the improvement comprising:

means for rotating each said valve shaft, said rotation means including means to index each said intake valve with said intake passage in a selected attitude of rotation with respect to said intake port, and means to index each said exhaust valve with said exhaust passage in a selected attitude of rotation with respect to said exhaust port, said indexing means including a rotatable intake indexing gear, said intake valve shaft rotating responsive to the rotation of said intake indexing gear;

said indexing means further including a rotatable exhaust indexing gear, said exhaust valve shaft rotating responsive to the rotation of said exhaust indexing gear;

each said indexing gear having a plurality of cam followers rotatably mounted thereon;

a cam driver, said cam driver having a cam track formed thereon, said indexing gear and said cam driver arranged in fixed spatial relationship to bring said cam track into engagement with successive of said cam followers on each said indexing gear as said cam driver is rotated, said cam track having at least one semi-circular segment of fixed radius, said cam track having at least one segment indented to lead away from and return to said semi-circular segment; and means formed on said cam driver to guide successive of said cam followers to enter, follow and exit said indented segment, whereby each said indexing gear is rotated from a first position to a second position as one said cam follower enters, follows and exits said indented segment, and remains in said second position until the next of said cam followers enters, follows and exits said indented segment.

* * * * *